US008918930B2

(12) United States Patent
Stroh et al.

(10) Patent No.: US 8,918,930 B2
(45) Date of Patent: Dec. 30, 2014

(54) METHODS AND APPARATUSES FOR LOW-AIR-LOSS (LAL) COVERLETS AND AIRFLOW UNITS FOR COVERLETS

(75) Inventors: Glenn C. Stroh, Marion, TX (US); John H. Vrzalik, San Antonio, TX (US); Cesar Z. Lina, Universal City, TX (US); Daniel W. Dekruif, San Antonio, TX (US); Bryan L. Johnson, New Braunfels, TX (US)

(73) Assignee: Huntleigh Technology Limited, Bedfordshire (GB)

( * ) Notice: Subject to any disclaimer, the term of this patent is extended or adjusted under 35 U.S.C. 154(b) by 362 days.

(21) Appl. No.: 13/343,580

(22) Filed: Jan. 4, 2012

(65) Prior Publication Data

US 2012/0167303 A1 Jul. 5, 2012

Related U.S. Application Data

(60) Provisional application No. 61/429,696, filed on Jan. 4, 2011.

(51) Int. Cl.
*A47C 21/04* (2006.01)

(52) U.S. Cl.
USPC ..... 5/423; 5/726; 5/652.2

(58) Field of Classification Search
USPC ..... 5/423, 421, 726, 652.2, 941
See application file for complete search history.

(56) References Cited

U.S. PATENT DOCUMENTS

| | | | | |
|---|---|---|---|---|
| 2,826,244 | A | 3/1958 | Hurley | 5/652.2 |
| 3,735,559 | A | 5/1973 | Salemme | 95/52 |
| 4,185,341 | A | 1/1980 | Scales | 5/699 |
| 4,483,030 | A | 11/1984 | Flick et al. | 5/691 |
| 4,825,488 | A | 5/1989 | Bedford | 5/726 |
| 4,853,992 | A | 8/1989 | Yu | 5/423 |
| 4,997,230 | A | 3/1991 | Spitalnick | 297/180.11 |
| 5,007,123 | A | 4/1991 | Salyards | 5/699 |
| 5,035,014 | A | 7/1991 | Blanchard | 5/424 |
| 5,249,319 | A | 10/1993 | Higgs | 5/714 |
| 5,416,935 | A | 5/1995 | Nieh | 5/423 |
| 5,473,783 | A | 12/1995 | Allen | 5/652.2 |
| 5,498,278 | A | 3/1996 | Edlund | 96/11 |
| 5,611,096 | A | 3/1997 | Bartlett et al. | 5/617 |
| 5,640,728 | A | 6/1997 | Graebe | 5/606 |
| 5,647,079 | A | 7/1997 | Hakamiun et al. | 5/713 |

(Continued)

FOREIGN PATENT DOCUMENTS

| | | |
|---|---|---|
| EP | 0 870 449 | 10/1998 |
| EP | 1 151 698 | 11/2001 |

(Continued)

OTHER PUBLICATIONS

AccuMax Quantum Complete, Hill-Rom Services, Inc., copyright 2008-2012. Available online at http://www.woundsource.com/print/product/accumax-quantum-complete. Accessed Mar. 15, 2012.

(Continued)

*Primary Examiner* — Fredrick Conley
(74) *Attorney, Agent, or Firm* — Fulbright & Jaworski LLP

(57) ABSTRACT

Improved patient support systems comprising a coverlet configured to be coupled (e.g., removably) to an airflow unit. Improved airflow units configured to be coupled (e.g., removably) to a coverlet of a patient support system.

24 Claims, 11 Drawing Sheets

(56) References Cited

U.S. PATENT DOCUMENTS

| | | | | |
|---|---|---|---|---|
| 5,681,368 | A | 10/1997 | Rahimzadeh | 95/52 |
| 5,701,621 | A | 12/1997 | Landi et al. | 5/691 |
| 5,755,000 | A | 5/1998 | Thompson | 5/713 |
| 5,882,349 | A | 3/1999 | Wilkerson et al. | 604/289 |
| 5,887,304 | A | 3/1999 | Von der Heyde | 5/726 |
| 5,926,884 | A | 7/1999 | Biggie et al. | 5/714 |
| 6,065,166 | A | 5/2000 | Sharrock et al. | 5/630 |
| 6,085,369 | A * | 7/2000 | Feher | 5/423 |
| 6,182,315 | B1 | 2/2001 | Lee | 5/690 |
| 6,272,707 | B1 | 8/2001 | Robrecht et al. | 5/724 |
| 6,288,076 | B1 | 9/2001 | Kostyniak et al. | 514/299 |
| 6,336,237 | B1 | 1/2002 | Schmid | 5/726 |
| 6,341,395 | B1 | 1/2002 | Chao | 5/423 |
| 6,353,950 | B1 | 3/2002 | Bartlett et al. | 5/617 |
| 6,418,579 | B2 | 7/2002 | Perez et al. | 5/713 |
| 6,421,859 | B1 | 7/2002 | Hicks et al. | 5/722 |
| 6,487,739 | B1 | 12/2002 | Harker | 5/729 |
| 6,493,889 | B2 | 12/2002 | Kocurek | 5/423 |
| 6,527,832 | B2 | 3/2003 | Oku et al. | 96/4 |
| 6,546,576 | B1 | 4/2003 | Lin | 5/423 |
| 6,671,911 | B1 | 1/2004 | Hill et al. | 5/713 |
| 6,687,937 | B2 | 2/2004 | Harker | 5/726 |
| 6,709,492 | B1 | 3/2004 | Spadaccini et al. | 96/6 |
| 6,779,592 | B1 | 8/2004 | Ichigaya | 165/46 |
| 6,782,574 | B2 | 8/2004 | Totton et al. | 5/726 |
| 6,868,569 | B2 | 3/2005 | VanSteenburg | 5/709 |
| 6,904,629 | B2 | 6/2005 | Wu | 165/46 |
| 7,036,163 | B2 | 5/2006 | Schmid | 5/423 |
| 7,140,495 | B2 | 11/2006 | Hester et al. | 210/490 |
| 7,165,281 | B2 | 1/2007 | Larssson et al. | 5/724 |
| 7,191,482 | B2 | 3/2007 | Romano et al. | 5/714 |
| 7,240,386 | B1 | 7/2007 | McKay et al. | 5/724 |
| 7,290,300 | B1 | 11/2007 | Khambete | 5/423 |
| 7,296,315 | B2 | 11/2007 | Totton et al. | 5/737 |
| 7,334,280 | B1 | 2/2008 | Swartzburg | 5/724 |
| 7,357,830 | B2 | 4/2008 | Weidmann | 95/52 |
| 7,480,953 | B2 | 1/2009 | Romano et al. | 5/714 |
| 7,631,377 | B1 | 12/2009 | Sanford | 5/423 |
| 7,637,573 | B2 | 12/2009 | Bajic et al. | 297/452.43 |
| 7,712,164 | B2 | 5/2010 | Chambers | 5/423 |
| 7,886,385 | B2 | 2/2011 | Carlitz | 5/691 |
| 7,913,332 | B1 | 3/2011 | Barnhart | 5/423 |
| 7,914,611 | B2 | 3/2011 | Vrzalik et al. | 96/11 |
| 7,937,789 | B2 | 5/2011 | Feher | 5/421 |
| 7,937,791 | B2 | 5/2011 | Meyer et al. | 5/727 |
| 7,966,680 | B2 | 6/2011 | Romano et al. | 5/713 |
| 8,118,920 | B2 | 2/2012 | Vrzalik et al. | 96/11 |
| 2001/0023512 | A1 | 9/2001 | Perez et al. | 5/713 |
| 2002/0129449 | A1 | 9/2002 | Harker | 5/726 |
| 2002/0148047 | A1 | 10/2002 | Corzani et al. | 5/738 |
| 2003/0019044 | A1 | 1/2003 | Larsson et al. | 5/724 |
| 2003/0145380 | A1 | 8/2003 | Schmid | 5/423 |
| 2004/0003471 | A1 | 1/2004 | VanSteenburg | 5/709 |
| 2004/0064888 | A1 | 4/2004 | Wu | 5/423 |
| 2004/0214495 | A1 | 10/2004 | Foss et al. | 442/199 |
| 2004/0237203 | A1 | 12/2004 | Romano et al. | 5/713 |
| 2005/0011009 | A1 | 1/2005 | Wu | 5/729 |
| 2005/0022308 | A1 | 2/2005 | Totton et al. | 5/713 |
| 2005/0086739 | A1 | 4/2005 | Wu | 5/423 |
| 2005/0188467 | A1 | 9/2005 | Woolfson | 5/726 |
| 2005/0278863 | A1 | 12/2005 | Bahash et al. | 5/726 |
| 2006/0010607 | A1 | 1/2006 | Schneider | 5/713 |
| 2006/0080778 | A1 | 4/2006 | Chambers | 5/652.2 |
| 2007/0056116 | A1 | 3/2007 | Galardo | 5/724 |
| 2007/0079077 | A1 * | 4/2007 | Baines et al. | 711/147 |
| 2007/0234481 | A1 | 10/2007 | Totton et al. | 5/714 |
| 2007/0261548 | A1 | 11/2007 | Vrzalik et al. | 96/11 |
| 2007/0266499 | A1 | 11/2007 | O'Keefe et al. | 5/713 |
| 2008/0022461 | A1 | 1/2008 | Bartlett et al. | 5/714 |
| 2008/0028536 | A1 | 2/2008 | Hadden-Cook | 5/724 |
| 2008/0060131 | A1 | 3/2008 | Tompkins | 5/423 |
| 2008/0098529 | A1 | 5/2008 | Flocard et al. | 5/652.2 |
| 2008/0263776 | A1 | 10/2008 | O'Reagan et al. | 5/714 |
| 2009/0322124 | A1 | 12/2009 | Barkow et al. | 297/180.14 |
| 2010/0043143 | A1 | 2/2010 | O'Reagan et al. | 5/421 |
| 2010/0095461 | A1 | 4/2010 | Romano et al. | 5/710 |
| 2010/0122417 | A1 | 5/2010 | Vrzalik et al. | 5/652.1 |
| 2010/0175196 | A1 | 7/2010 | Lafleche et al. | 5/707 |
| 2010/0287701 | A1 | 11/2010 | Frias | 5/423 |
| 2011/0004997 | A1 | 1/2011 | Hale et al. | 5/699 |
| 2011/0010850 | A1 | 1/2011 | Frias | 5/423 |
| 2011/0010855 | A1 | 1/2011 | Flessate | 5/484 |
| 2011/0035880 | A1 | 2/2011 | Cole et al. | 5/423 |
| 2011/0107514 | A1 | 5/2011 | Brykalski et al. | 5/421 |
| 2011/0219548 | A1 * | 9/2011 | Vrzalik et al. | 5/699 |

FOREIGN PATENT DOCUMENTS

| | | |
|---|---|---|
| EP | 1 645 258 | 4/2006 |
| EP | 1 687 139 | 8/2006 |
| EP | 1 863 369 | 12/2007 |
| EP | 1 901 636 | 3/2008 |
| EP | 1 919 328 | 5/2008 |
| EP | 1 971 246 | 9/2008 |
| EP | 2 047 770 | 4/2009 |
| EP | 2 258 242 | 12/2010 |
| EP | 2 319 474 | 5/2011 |
| JP | H02-11144 | 1/1990 |
| JP | 11-164757 | 6/1999 |
| JP | 11-169262 | 6/1999 |
| JP | 11-332697 | 12/1999 |
| JP | 2000-152854 | 6/2000 |
| JP | 2002-125809 | 5/2002 |
| JP | 2003-230605 | 8/2003 |
| JP | 2004-188052 | 8/2004 |
| WO | WO 2004/082551 | 9/2004 |
| WO | WO 2005/046988 | 5/2005 |
| WO | WO 2006/122614 | 4/2006 |
| WO | WO 2007/003018 | 6/2006 |
| WO | WO 2006/105169 | 10/2006 |
| WO | WO 2007/034311 | 3/2007 |
| WO | WO 2011/067720 | 6/2011 |

OTHER PUBLICATIONS

Gaymar SPR-Plus, Pressure Distributing Low Air Loss System, Gaymar Industries, Inc. Product Brochure. Copyright 2009. Available online at http://www.gaymar.com/wcsstore/ExtendedSitesCatalogAssetStore/pdf/SPR_Plus_New_5.pdf. Accessed Mar. 15, 2012.

Reger et al., "Validation test for climate control on air loss supports," *Arch. Phys. Med. Rehab.*, 82:597-603, 2001.

Span America PressureGuard Easy Air Low Air Loss Product, Span America, Product Page, Copyright 2012. Available online at http://www.spanamerica.com/easy_air.php. Accessed Mar. 15, 2012.

* cited by examiner

METHODS AND APPARATUSES FOR LOW-AIR-LOSS (LAL) COVERLETS AND AIRFLOW UNITS FOR COVERLETS

CROSS-REFERENCE TO RELATED APPLICATIONS

This application claims priority to U.S. Provisional Patent Application No. 61/429,696, filed Jan. 4, 2011, which is incorporated herein in its entirety.

BACKGROUND

1. Field of the Invention

The present invention relates generally to beds and patient support surfaces, and, more particularly, but not by way of limitation, to patient supports having low-air-loss (LAL) coverlets, and LAL coverlets for patient supports.

2. Description of Related Art

Various apparatuses are known in the art for supporting patients. For example, some hospital and other beds include a mattress with a plurality of inflatable chambers (e.g., transverse chambers). Some such support apparatuses have an articulable frame that includes a back section, a seat section, and a leg section, each of which may be pivotable relative to one or more of the other sections.

Patients and other persons restricted to bed for extended periods incur the risk of forming decubitus ulcers. Decubitus ulcers (commonly known as bed sores, pressure sores, pressure ulcers, etc.) can be formed when blood supplying the capillaries below the skin tissue is interrupted due to external pressure against the skin. This pressure can be greater than the internal blood pressure within a capillary and thus, occlude the capillary and prevent oxygen and nutrients from reaching the area of the skin in which the pressure is exerted. Moreover, moisture and heat on and around the person may, in some instances, exacerbate ulcers by causing skin maceration, among other associated issues.

The following disclose examples of information related to certain of these background issues and/or certain patient supports: Reger S I, Adams T C, Maklebust J A, Sahgal V: Validation Test for Climate Control on Air Loss Supports; Arch. Phys. Med Rehab. 2001; 82:597-603; U.S. Pat. No. 7,914,611; U.S. Patent Publication No.: US 2008/0022461 A1 (application Ser. No. 11/780,119) filed Jul. 19, 2007; US 2010/0122417 A1 (application Ser. No. 12/622,260), filed Nov. 19, 2009.

SUMMARY

This disclosure includes embodiments of patient support apparatuses, control units, and methods.

Exemplary embodiments of the present disclosure are directed to apparatus, systems and methods to aid in the prevention of decubitus ulcer formation and/or promote the healing of such ulcer formation. Certain exemplary embodiments comprise a multi-layer support system that can be utilized to aid in the removal of moisture, vapor, and heat adjacent and proximal the patient surface interface and in the environment surrounding the patient. Certain exemplary embodiments provide a surface that absorbs and/or disperses the moisture, vapor, and heat from the patient.

Some embodiments of the present support systems comprise: a coverlet (e.g., comprising: a first layer comprising a vapor-permeable and liquid-impermeable material; and a second layer comprising a liquid-impermeable material, the second layer coupled to the first layer such that a plurality of flow paths are formed between the first layer and the second layer); and an airflow unit (e.g., comprising: a first housing member having at least one opening in fluid communication with the plurality of flow paths; a second housing member coupled to the first housing member; and an air mover disposed between the first and second housing members); where the airflow unit is coupled to the coverlet such that the air mover can be activated to move air through the plurality of flow paths.

In some embodiments, the second layer comprises a vapor-permeable material.

In some embodiments, the first housing member is coupled to the second layer. In some embodiments, the first housing member is coupled to the second layer by adhesive. Some embodiments further comprise an interface gasket disposed between the second layer and the first housing member. In some embodiments, the interface gasket is coupled to the first housing member and the second housing member by adhesive. Some embodiments further comprise a housing gasket disposed between the first housing member and the second housing member. In some embodiments, In some embodiments, the second layer has an inner side facing toward the first layer, and an outer side facing away from the first layer, and the second housing member is disposed on the outer side of the second layer.

In some embodiments, the first housing member is disposed between the first layer and the second layer. In some embodiments, the air mover is disposed between the second layer and the second housing member. In some embodiments, the first housing member includes two or more protrusions extending through the second layer, and the second housing member is coupled to the two or more protrusions. In some embodiments, the two or more protrusions each includes a barb, and the second housing member includes two or more tabs coupled to the barbs.

In some embodiments, the second housing member includes at least one opening. In some embodiments, at least one of the first and second housing members comprises one or more pins, and the air mover comprises one or more holes corresponding to the one or more pins, such that if the one or more of pins extend into the one or more corresponding openings, and the second housing member is coupled to the first housing member, the air mover is substantially fixed relative to the one of the first and second housing members.

In some embodiments, the first layer comprises a cushioning material. In some embodiments, the second layer comprises a plurality of protrusions. In some embodiments, the coverlet is configured to be coupled to a support member. In some embodiments, the coverlet further comprises a coupling member configured to couple the support system to a support member. In some embodiments, the support member comprise a mattress. In some embodiments, the coupling member is selected from the group consisting of: a strap, zipper, button, buckle, and hook-and-loop fastener.

In some embodiments, the air mover comprises a fan, a pump, or a blower. In some embodiments, the support system is configured such that if the air mover is activated while a patient is disposed on the coverlet: moisture vapor will transfer through the first layer into the plurality of flow paths; and the air mover will transfer the moisture vapor from the plurality of flow paths, through the inlet housing of the first housing member, and to an exterior of the coverlet. In some embodiments, the support system is configured to be disposed of after a single use.

Some embodiments of the present airflow units are for use with a low-air-loss coverlet comprising a first layer and a second layer coupled to the first layer such that a plurality of flow paths are formed between the first layer and the second layer, and the airflow unit comprises: a first housing member having two or more protrusions, the first housing member configured to be disposed between first and second layers of a coverlet such that the two or more protrusions extend through the second layer; a second housing member configured to be coupled to the two or more protrusions on an opposite side of the second layer from the first housing member; and an air mover configured to be disposed between the first and second housing members such that if the airflow unit is coupled to a coverlet, the air mover can be activated to move air in the plurality of flow paths.

In some embodiments, at least one of the first and second housing members comprises one or more pins, and the air mover comprises one or more holes corresponding to the one or more pins, such that if the one or more of pins extend into the one or more corresponding openings, and the second housing member is coupled to the first housing member, the air mover is substantially fixed relative to the one of the first and second housing members.

Some embodiments of the present airflow units are for use with a low-air-loss (LAL) coverlet, and the airflow unit comprises: a first housing member; a second housing member coupled to the first housing member; an air mover disposed between the first and second housing members; where the first and second housing members define a first opening and a second opening; and where at least one of the first and second housing members includes a flange surrounding the first opening, the flange configured to be removably coupled to a coupling member of a coverlet such that the airflow unit is in fluid communication with the air mover.

In some embodiments, the flange extends from the at least one of the first and second housing members in a direction that is substantially parallel to the first axis of the first opening. In some embodiments, the first opening has a first axis, and the second opening has a second axis that is not parallel to the first axis. In some embodiments, the first axis of the first opening is substantially perpendicular to the second axis of the second opening. In some embodiments, the airflow unit comprises guide vanes configured to align fluid flowing through the first opening.

Some embodiments of the present support systems comprise: an embodiment of the present airflow units; and a coverlet comprising: a first layer comprising a vapor-permeable and liquid-impermeable material; a second layer comprising a liquid-impermeable material, the second layer coupled to the first layer such that a plurality of flow paths are formed between the first layer and the second layer; and a coupling member in fluid communication with the plurality of flow paths; where the coupling member is coupled to the flange of the airflow unit such that the air mover is in fluid communication with the plurality of flow paths.

In some embodiments, the second layer comprises a vapor-permeable material. Some embodiments further comprise: a mattress comprising a compartment configured to removably receive an embodiment of the present airflow units, the mattress comprising a passage configured to permit the coupling member of the coverlet to be coupled to the flange of the airflow unit if the airflow unit is received in the compartment.

In some embodiments, the coverlet is configured to be coupled to the mattress such that the coupling member of the coverlet can be coupled to the flange of the airflow unit if the airflow unit is received in the compartment of the mattress.

Some embodiments of the present support systems comprise: a coverlet (e.g., comprising; a first layer comprising a vapor-permeable and liquid-impermeable material; and a second layer comprising a liquid-impermeable material, and a plurality of protrusions; where the second layer is coupled to the first layer such a plurality of flow paths are formed between the first layer and the second layer); and an airflow unit (e.g., comprising: a first housing member disposed between the first layer and the second layer, the first housing member comprising two or more protrusions extending through the second layer; and a second housing member coupled to the protrusions on an opposite side of the first layer from the first housing member, the second housing member comprising a flange configured to be coupled to a conduit such that an air mover can be coupled to the conduit for fluid communication between the air mover and the plurality of flowpaths of the coverlet).

In some embodiments, the second layer comprises a vapor-permeable material. In some embodiments, the two or more protrusions each includes a barb, and the second housing member includes two or more tabs coupled to the barbs.

Any embodiment of any of the present devices and kits can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DESCRIPTION OF ILLUSTRATIVE EMBODIMENTS

Figure 1A:
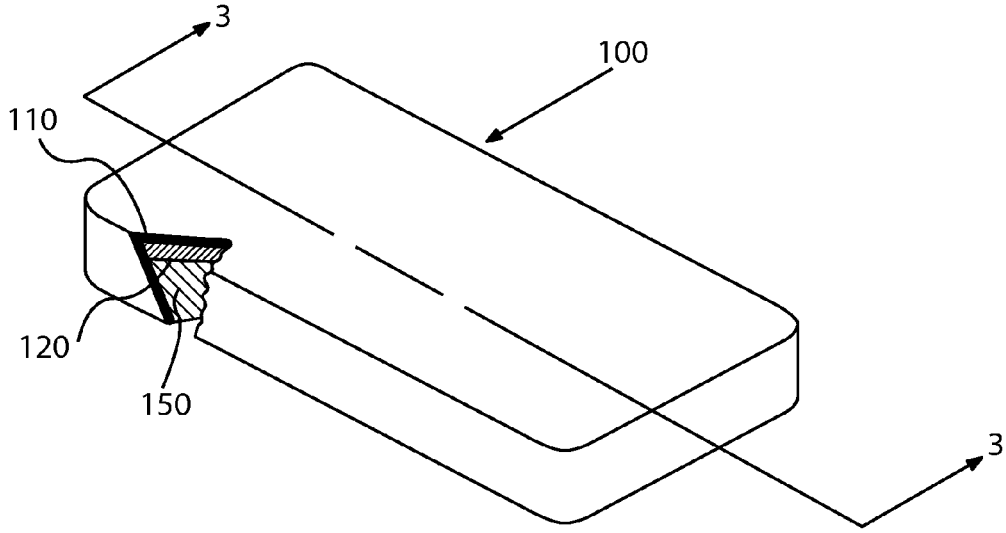
FIGS. 1A and 1B depict perspective and bottom views, respectively, of one embodiment of a patient support including a low-air-loss (LAL) coverlet coupled to a mattress.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device or kit that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Further, a device, system, or structure that is configured in a certain way is configured in at least that way, but it can also be configured in other ways than those specifically described.

Some of the present embodiments include systems configured (e.g., with components configured) to aid in prevention of decubitus ulcer formation and/or to remove moisture and/or heat from the patient. For example, some embodiments include a multi-layer patient support (e.g., support system) that can be used in conjunction with a variety of support surfaces, such as an inflatable mattress, a foam mattress, a gel mattress, a water mattress, or a RIK® Fluid Mattress of a hospital bed. In such embodiments, features of the multi-layer support system can help to remove moisture from the patient, while features of the mattress can aid in the prevention and/or healing of decubitus ulcers by further lowering interface pressures at areas of the skin in which external pressures are typically high, such as, for example, at bony prominences such as the heel and the hip area of the patient. Other embodiments include one of the present multi-layer supports in conjunction with a chair or other support platform.

Some embodiments are configured for single or one-time use (e.g., are configured to be disposed of after a single use or a use for a predetermined amount of time. As used herein, a single-use or one-time use support system is a support system for single-patient use applications that is formed of material that is disposable and/or inexpensive and/or manufactured and/or assembled in a low-cost manner and is intended to be used for a single patient over a brief period of time, such as an hour(s), a day, or multiple days (e.g., 2, 5, or more days).

Figure 1B:
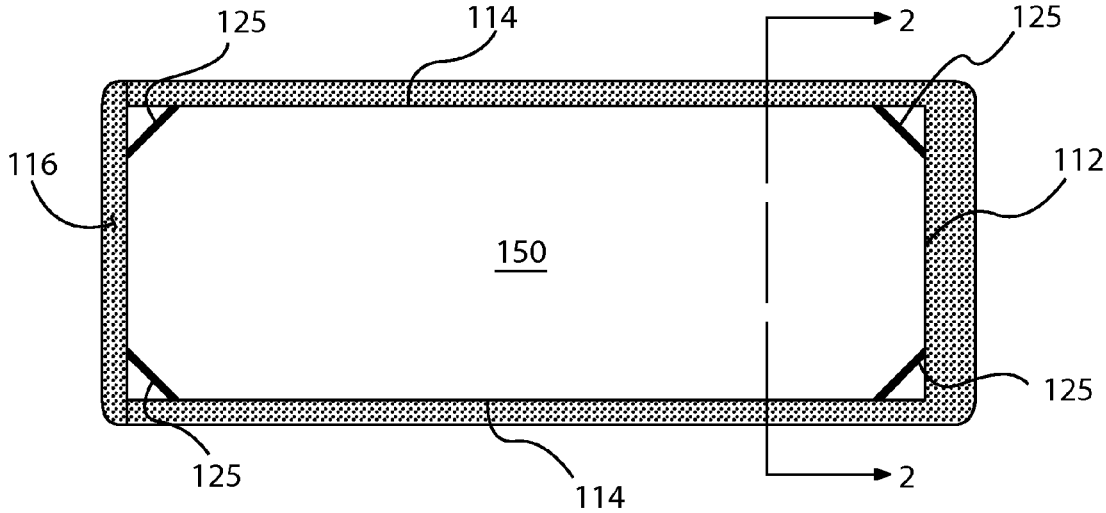
Figure 2:
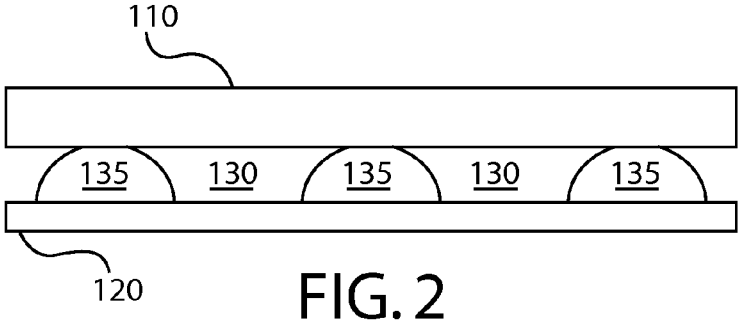
FIG. 2 depicts a cross-sectional view of the LAL coverlet of FIGS. 1A and 1B.
Figure 3:
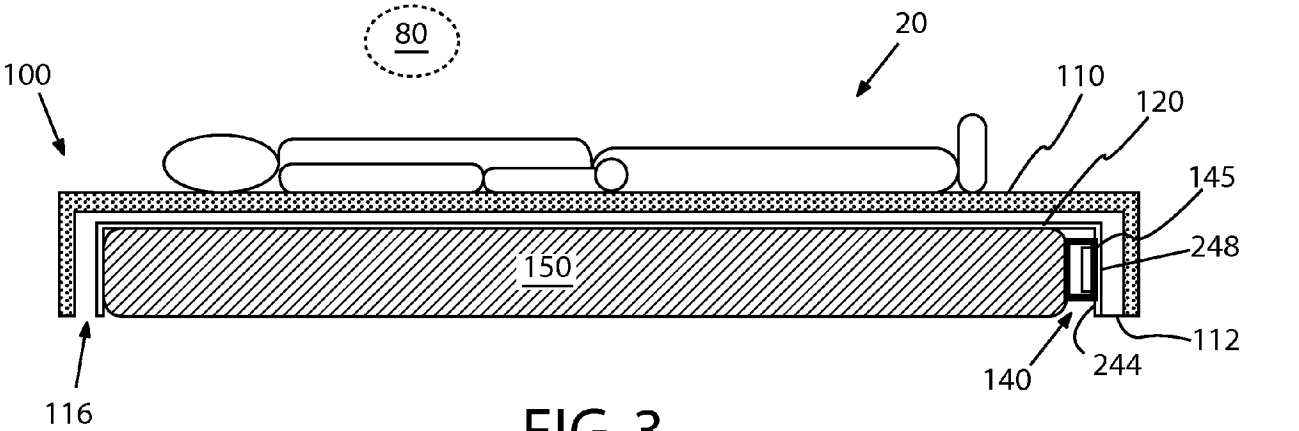
FIG. 3 depicts a cross-sectional view of the patient support of FIGS. 1A and 1B, with a patient supported on the patient support.

Referring now to the drawings, and more particularly to FIGS. 1-3, shown therein is an embodiment of a support system or low-air-loss (LAL) coverlet 100 shown coupled to a mattress 150 (e.g., a fluid-fillable mattress). In the embodiment shown, support system 100 is configured to extend around the sides of mattress 150, and to and around a portion of the lower surface of mattress 150. Mattress 150 can be any configuration known in the art for supporting a person. For example, in certain exemplary embodiments, mattress 150 may be an alternating-pressure-pad-type mattress or other type of mattress using air to inflate or pressurize a cell or chamber within the mattress. In other embodiments, mattress 150 does not utilize air to support a person. In some embodiments support system 100 may be used in seating applications (e.g., wheelchairs, chairs, recliners, benches, etc.).

FIG. 1A depicts a partially cutaway perspective view of a support system 100 mounted on a mattress 150. In the embodiment shown, support system 100 comprises first layer 110 and second layer 120. In FIG. 1A, support system 100 is shown coupled to mattress 150. FIG. 1B depicts the underside of mattress 150 with support system 100 coupled to mattress 150. In some embodiments, support system 100 may be coupled to mattress 150 via a coupling member 125, as shown in FIG. 1B. In certain embodiments, coupling member 125 may comprise elastic (e.g., an elastic strap). In other embodiments, coupling member 125 comprises one or more of: a hook-and-loop fastener, buttons, snaps, straps, zippers, and/or other suitable coupling devices or components. In other embodiments, support system 100 may be coupled to mattress 150 by tucking material (e.g. a first layer 110 and/or a second layer 120) from support system 100 under mattress 150. In embodiments in which support system 100 is used in seating applications, coupling member 125 may couple support system 100 to a seat (not shown).

As shown in FIG. 1B, in some embodiments, first layer 110 and second layer 120 are joined at sealed end 112 and sealed sides 114 to form an airtight seal (e.g., such that one or more chambers, channels, and/or flow paths are formed between first layer 110 and second layer 120). Sealed end 112 and sealed sides 114 may be stitched, glued, epoxied, welded, radio-frequency welded, or otherwise joined such that an airtight or substantially airtight seal is formed. In some embodiments, first layer 110 and second layer 120 are not joined along one edge, forming opening 116. In other embodiments, first layer 110 and 120 are joined by a vent material that allows for the ready passage of air and moisture vapor through opening 116. In other embodiments, opening 116 comprises a valve, a slit, or a hole through which air and moisture vapor may pass.

FIG. 2 depicts a cross-sectional view of support system 100 taken along section line 2-2 in FIG. 1B, showing channels 130 formed between first layer 110 and second layer 120. As shown in FIG. 2, second layer 120 is in partial contact with first layer 110 such that a plurality of channels 130 are formed between first layer 110 and second layer 120. In exemplary embodiments, having second layer 120 in partial contact with first layer 110 allows air to flow through channels 130 when a person is laying on system 100 while the system is coupled to and/or supported by a mattress.

In some embodiments, second layer 120 comprises a plurality of protrusions 135. In some embodiments, second layer 120 may comprise a cellular cushioning material. In some embodiments, second layer 120 may comprise a plastic sheet material (e.g., polyethylene). In some embodiments, protrusions 135 comprise encapsulated cells or volumes (e.g., regularly spaced encapsulated cells or volumes). In some embodiments, the encapsulated cells or volumes may contain a volume of gas (e.g., most or all of the encapsulated cells or volumes may be filled with air or other gas). The encapsulated cells or volumes may, in some embodiments, have a substantially circular shape or cross-section. One example of a material that may be used for second layer 120 is sold under the trade name Bubble Wrap®. Other similar products may be used. In other embodiments, instead of protrusions 135, system 100 comprises a spacer layer (disposed where protrusions 135 are shown, such as spacer layer 404 in FIG. 9)

between first layer 110 and second layer 120. Such a spacer layer is configured to provide a space between first layer 110 and second layer 120, and to provide flow paths 130 (e.g., via pores, channels, or the like) to permit system 100 to function as described in this disclosure. For example, in some embodiments, this spacer layer includes a layer of open-celled foam, such as, a large-celled and open-celled polyurethane (PU) foam. One example of an open-celled PU foam has a density of 1.8-2.2 lbs per cubic foot, a pore size (visual) of 30±10 pores per inch and is marketed under the trade name DRI-FAST by Foamex, U.S.A. Other types of materials may also be used for a spacer layer, such as, for example, fibrous and/or any other materials or configurations that provide the described flow paths 130 between first layer 110 and second layer 120.

FIG. 3 discloses a cross-sectional view of support system 100 and mattress 150 taken along section line 3-3 in FIG. 1A. As shown, support system 100 comprises first layer 110, second layer 120, and an airflow unit 140. In this embodiment, support system 100 is configured such that first layer 110 is the layer that will contact a patient 20 that is supported by support system 100. Support system 100 is further configured such that second layer 120 is between first layer 110 and mattress 150.

In the embodiment shown, first layer 110 comprises a material that is vapor-permeable and liquid-impermeable. First layer 110 may be air permeable or air-impermeable. An example of a material that is vapor-permeable, liquid-impermeable, and air-impermeable is a hospital bedsheet comprising polyurethane. An example of a material that is vapor-permeable, liquid-impermeable, and air permeable is a hospital bedsheet comprising polytetrafluoroethylene. In the embodiment shown, second layer 120 comprises a material that is vapor-permeable and liquid-impermeable. Second layer 120 may be air permeable or substantially air-impermeable.

In the embodiment shown, airflow unit 140 is located between second layer 120 and mattress 150 if system 100 is coupled to mattress 150. Airflow unit 140 is in fluid communication with channels 130 between first layer 110 and second layer 120. In certain exemplary embodiments, airflow unit 140 may comprise a guard 145 or other partition to prevent material from blocking the inlet or outlet of airflow unit 140. In some embodiments, airflow unit 140 is configured to pull air into opening 116 through channels 130 toward airflow unit 140 by applying a negative pressure to channels 130.

In some embodiments, the present airflow units (e.g., 140) comprise an air mover (e.g., a fan, a pump, a blower, or the like). One example of an air mover that is suitable for at least some of the present embodiments is a 12 volt DC fan such as an ACT-RX Technology Corporation CeraDyna Fan (Model 5115). In some embodiments, airflow unit 140 is 5.1 cm wide by 5.1 cm tall by 1.5 cm thick and weighs approximately 25 grams. In some embodiments, airflow unit 140 produces an air flow of about 4.10 cfm (0.12 cmm), a maximum air pressure of 16.08 mm-$H_2O$, and has an acoustical noise rating of 37.5 dB(A). This CeraDyna Fan is a centrifugal fan that is configured to move air perpendicular to the axis of rotation of the blades. By using an air mover such as the CeraDyna Fan or other similarly-sized devices, airflow unit 140 can be positioned adjacent to second layer 120, allowing for a more compact overall design of support system 100. For example, airflow unit 140 may be coupled to second layer 120 and first layer 110 with a substantially airtight seal so that air does not flow around airflow unit 140. In some embodiments, airflow unit 140 can be disposed in a location that is not between mattress 150 and the patient, such that airflow unit 140 will not adversely affect the patient's comfort. In embodiments in which airflow unit 140 is sufficiently small, air mover 140 may be placed between the patient and mattress 150 without adversely affecting the patient's comfort.

In other embodiments, air mover 140 may be external to and/or remote from first layer 110 and second layer 120 with appropriate connecting members such as tubing, piping or duct work, etc. In such embodiments, air mover 140 is in fluid communication with channels or flow paths 130. For example, air mover 140 may be a pump that is remote from and coupled to first layer 110 and second layer 120 with tubing and/or a valve. In some embodiments, air mover 140 may be configured to apply a positive pressure to channels 130. Air mover 140 may be configured to intake ambient air and blow the ambient air through channels 130 away from air mover 140 and toward opening 116.

Figure 4:
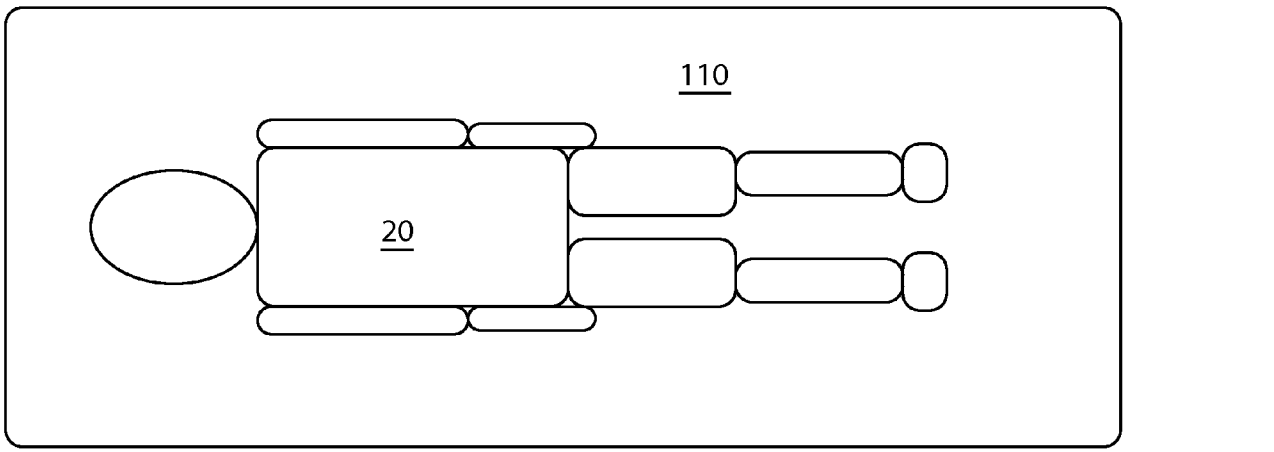
FIG. 4 depicts a top view of the patient support of FIGS. 1A and 1B, with a patient supported on the patient support.

FIG. 4 depicts a top view of a patient 20 laying on first layer 110 of support system 100. As discussed above, when patient 20 lays on support system 100 for an extended period of time, moisture (e.g., perspiration) may tend to accumulate between patient 20 and first layer 110. The amount of accumulated moisture may be expressed in terms of relative humidity (%), which is generally describes the amount of water vapor that exists in a gaseous mixture of air and water vapor, compared to the upper limit of what it could be at the same temperature and bulk pressure. The present embodiments of system 100 and/or airflow units 140 (140*a*, 140*b*, etc.) can be configured such that if the air mover is activated while a patient is disposed on the coverlet: moisture vapor will transfer through the first layer into the plurality of channels; and the air mover will transfer the moisture vapor from the plurality of channels, through the opening of the first housing member, and to an exterior of the coverlet.

Figure 5:
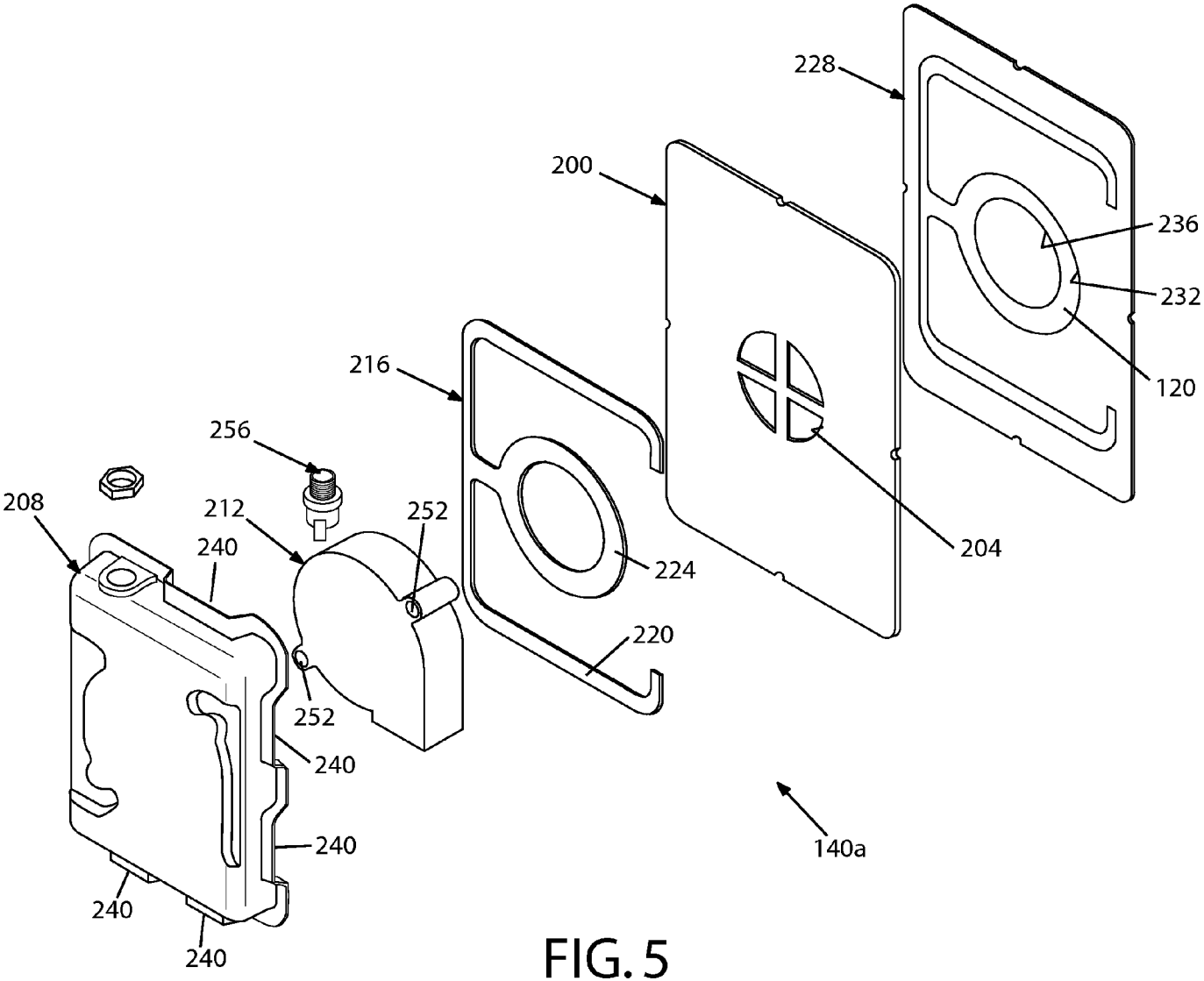
FIG. 5 depicts an exploded perspective view of an embodiment of the present airflow units for LAL patient supports such as the one depicted in FIGS. 1A-4.
Figure 6A:
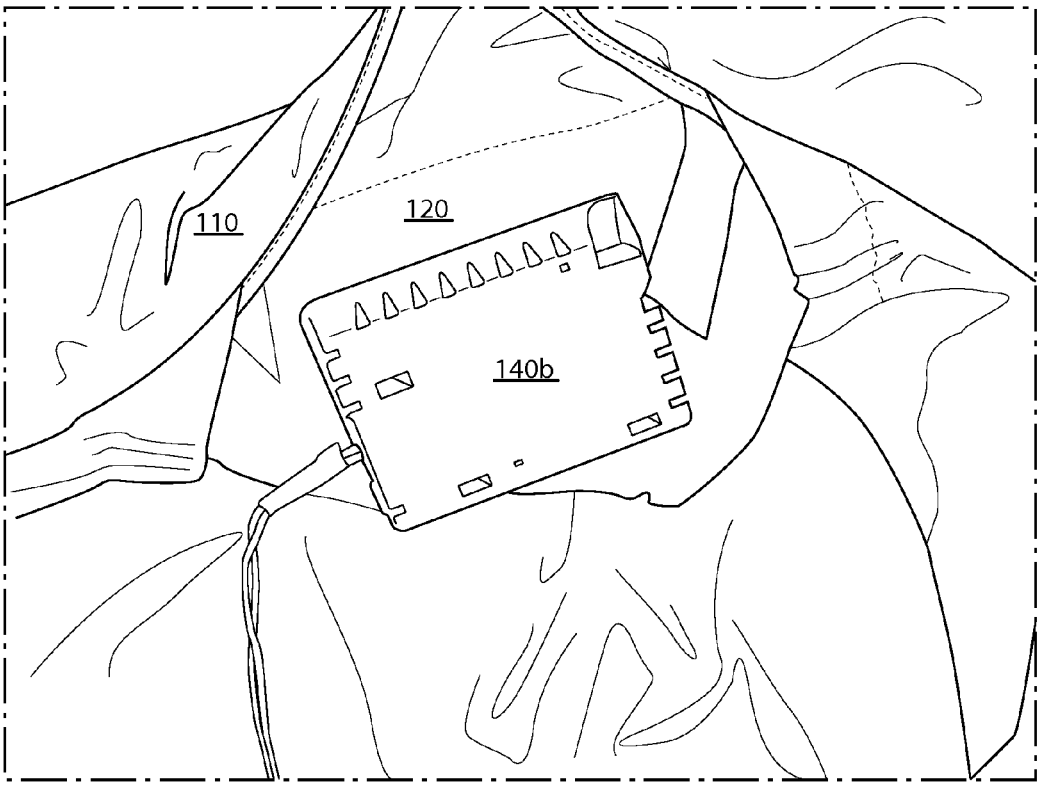
FIGS. 6A-6D depict various views of another embodiment of the present airflow units for LAL patient supports such as the one depicted in FIGS. 1A-4.
Figure 6B:
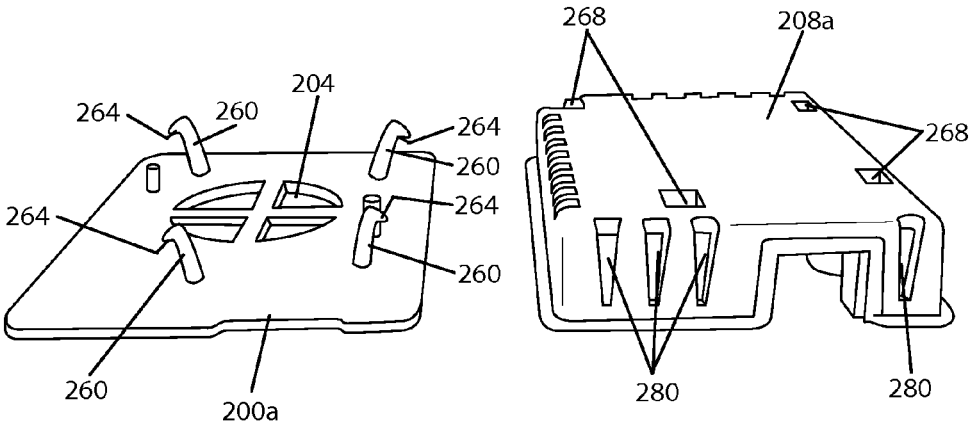
Figure 6C:
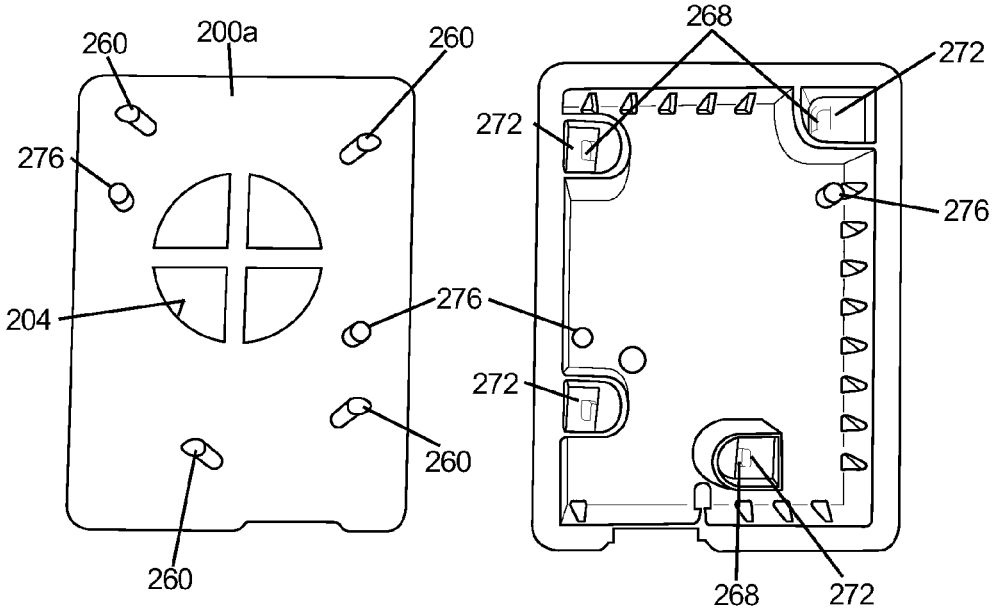
Figure 6D:
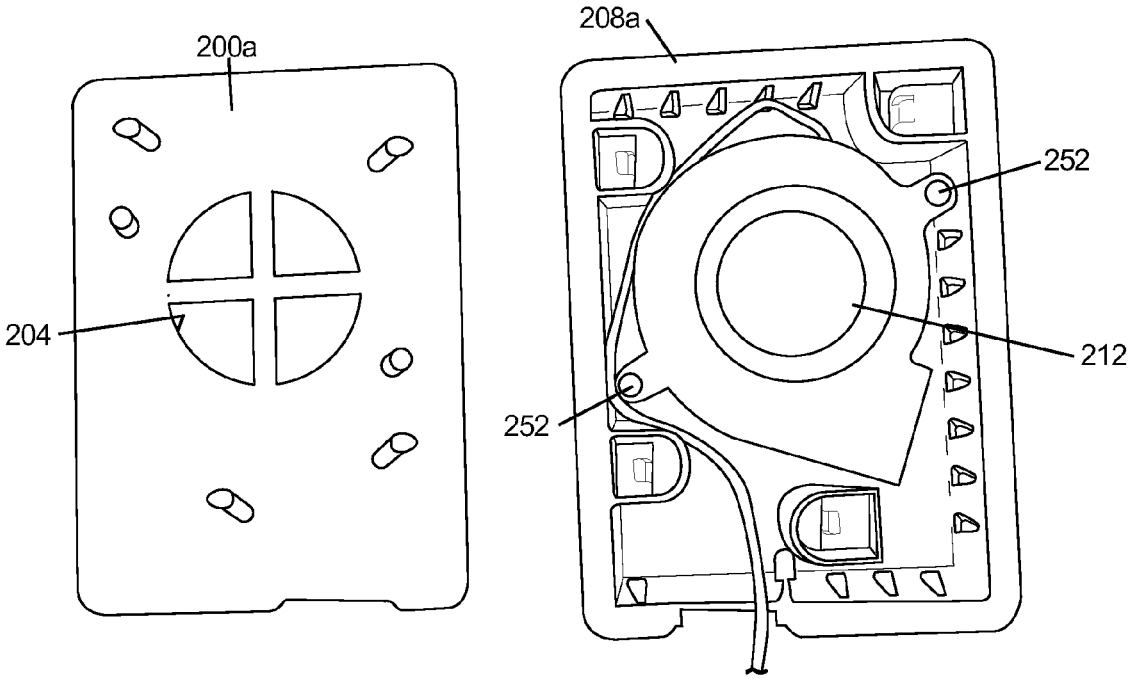

FIG. 5 depicts an exploded perspective view of an embodiment 140*a* of the present airflow units for LAL patient supports such as the one depicted in FIGS. 1A-4. In some embodiments, second housing member 208 is configured to help prevent or reduce the likelihood of foam or fabric entering the air mover when airflow unit 140 is in use. For example, in the embodiment shown, openings 204 are at least partially defined by a crosshair shape in first housing member 200. Other embodiments may have similar configurations, or may include gratings or perforated openings (e.g., multiple smaller openings). In the embodiment shown, airflow unit 140*a* comprises a first housing member 200 having at least one opening 204 in fluid communication with the plurality of flow paths or channels 130; a second housing member 208 configured to be coupled to first housing member 200; and an air mover 212 disposed between first housing member 200 and second housing member 208. In the embodiment shown, airflow unit 140*a* is configured to be coupled to coverlet 100 such that the air mover can be activated to move air through the plurality of channels or flow paths 130.

In the embodiment shown, first housing member 200 is coupled to second housing member 208 (e.g., via an adhesive and/or a gasket 216 which may, for example, be an adhesive gasket). In the embodiment shown, gasket 216 includes a peripheral portion 220 and an air-mover portion 224. Peripheral portion 220 extends around and is configured to seal at least a portion (e.g., up to and including all) of the peripheral seam or joint between first housing member 200 and second housing member 208. Air-mover portion 224 of gasket 216 is configured to extend around one or more openings 204 through which air mover 212 can fluidly communicate with coverlet 100 when airflow unit 140*a* is coupled to coverlet 100 (e.g., such that air-mover portion 224 substantially prevents leaks at the interface between air mover 212 and first housing member 200). In the embodiment shown, airflow unit 140 comprises an interface gasket 228 disposed between first housing member 200 and second layer 120 of coverlet 100. Interface gasket 228 may, for example, be an adhesive gasket and/or may otherwise be coupled to first housing member 200 and second layer 120 by adhesive. In the embodiment shown, interface gasket 228 is configured to substantially seal the interface between first housing member 200 and coverlet 100 (second layer 120). In some embodiments, gasket 216 and interface gasket 228 are formed from the same piece of gasket material. For example, in the embodiment shown, gasket 216 is smaller than interface gasket 228 such that gasket 216 is cut out of interface gasket 228, as shown, conserving gasket material and simplifying manufacturing and shipping of components. For example, in the embodiment shown, gasket 216 and 228 can be cut out of a common piece of gasket material and shipped in a single layer (e.g., with a common backing material, such as wax paper), such as in a kit, such that gasket 216 and interface gasket 228 can be removed from the backing material (not shown) to assemble airflow unit 140*a*. As shown, interface gasket includes a central hole or opening 232 that is configured to be positioned over a corresponding hole or opening 236 in second layer 120 of coverlet 100.

In the embodiment shown, first housing member 200 and second housing member 208 cooperate to define at least one opening 240 (e.g., as shown, a plurality of openings 240). For example, as shown, the perimeter of second housing member 208 includes a plurality of indented portions configured such that when second housing member 208 is coupled to first housing member 200, the indented portions of second housing member 208 leave spaces between second housing member 208 and first housing member 200 (openings 240) through which air mover 212 can push or pull air. As best shown in FIG. 3, second layer 120 has an inner side 244 facing toward first layer 110, and an outer side 248 facing away from first layer 110. In the embodiment shown in FIG. 5, airflow unit 140*a* is configured to be coupled to second layer 120 such that second housing member 208 is disposed on outer side 244 of second layer 120 (e.g., such that interface gasket 228 is coupled to outer side 244 of second layer 120).

In the embodiment shown, and as is depicted in additional detail for airflow unit 140*b*, second housing member 208 of airflow unit 140*a* comprises one or more (e.g., two) pins (not shown), and air mover 212 comprises one or more holes 252 corresponding to the one or more pins, such that if the one or more pins extend into the one or more corresponding holes 252, and second housing member 208 is coupled to first housing member 200, air mover 212 is substantially fixed relative to second housing member 208 (e.g., and first housing member 200). In the embodiment shown, airflow unit 140*a* also includes an electrical plug or connection 256 connected to second housing member 208, and electrically coupled to air mover 212 such that a power source (e.g., battery, power outlet, and/or the like) can be removably coupled to airflow unit 140*a* to power air mover 212.

In alternate embodiments of airflow unit 140*a*, first housing member 200 may be omitted, such that second housing member 208 is coupled to coverlet 100 (e.g., second layer 120) by gasket 216. In such embodiments, peripheral portion 220 may extend around the entire perimeter of second housing member 208. In such embodiments, a second gasket or grating member may be coupled to opening 236 in coverlet 100 to provide a crosshair or other grating structure to prevent or reduce the likelihood of fabric or foam entering air mover 212.

FIGS. 6A-6D depict various views of another embodiment 140*b* of the present airflow units for LAL patient supports such as the one depicted in FIGS. 1A-4. Airflow unit 140*b* is similar in some respects to airflow unit 140*a*, and the differences will be primarily described. In the embodiment shown, first housing member 200*a* is configured to be (and in certain of the present support systems, is) disposed between first layer 110 and second layer 120 of coverlet 100. In the embodiment shown, first housing member 200*a* can be disposed between first and second layers 110 and 120, and second housing member 208*a* can be coupled to first housing member 200*a* such that air mover 212 is disposed between second layer 120 and second housing member 208*a*. More particularly, in the embodiment shown, first housing member 200*a* includes two or more protrusions 260 configured to extend through second layer 120 of coverlet 100 (or, in other embodiments, through first layer 110) such that second housing member 200*b* can be coupled to protrusions 260 on an opposite side of second layer 120 (e.g., such that second housing member 208*a* is disposed on outer side 244 (FIG. 3) of second layer 120). Second housing member 208*a* can be coupled and/or connected to protrusions 260 in any suitable fashion (e.g., screws, adhesive, barbs, friction, snaps, etc.).

For example, in the embodiment shown, each of protrusions 260 includes a barb 264, and second housing member 208 includes a plurality of corresponding holes 268 and tabs 272, such that protrusions 260 can be pressed through the corresponding holes 268 such that barbs 264 engage or are otherwise coupled to tabs 272. In such embodiments, second layer 120 (or first layer 110) is disposed (e.g., pinched) between first and second housing members 200*a* and 208*b*, and airflow unit 140*b* can be coupled to coverlet (e.g., second layer 120) without gaskets, adhesive, screws, or additional hardware. In other embodiments, holes 268 may be omitted and tabs can be provided on an interior side of second housing member 208*a*.

Similarly to what is described above for first housing member 200 of airflow unit 140*a*, airflow unit 140*b* (e.g., first housing member 200*a* and/or second housing member 208*a*) includes one or more (e.g., two, three, four) pins 276, and air mover 212 comprises one or more corresponding holes 252 corresponding to the one or more pins 276, such that if pins 276 extend into holes 252, and second housing member 208*a* is coupled to first housing member 200*a*, air mover 212 is substantially fixed relative to second housing member 208*a*. In the embodiment shown, second housing member 208*a* includes at least one opening (e.g., a plurality of openings) 280. For example, in the embodiment shown, second housing member 208*a* includes a plurality of openings around the perimeter or a peripheral surface of second housing member 208*a*.

Figure 7A:
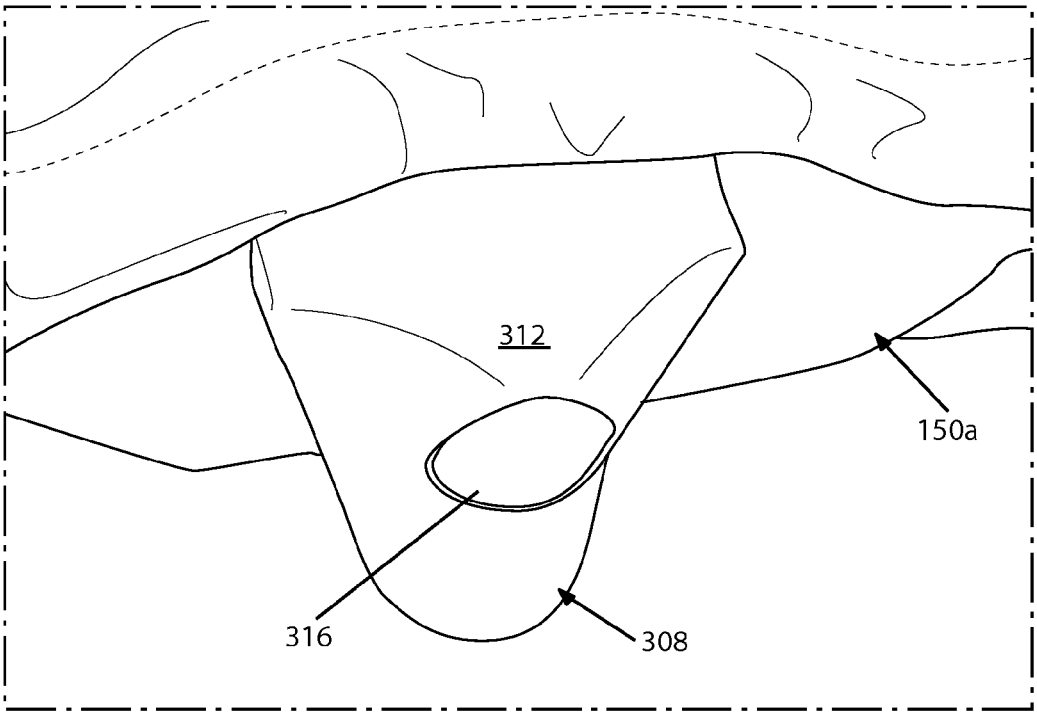
FIGS. 7A-7I depict various views of an embodiment of the present LAL patient supports, including a mattress, an LAL coverlet, and another one of the present airflow units.
Figure 7B:
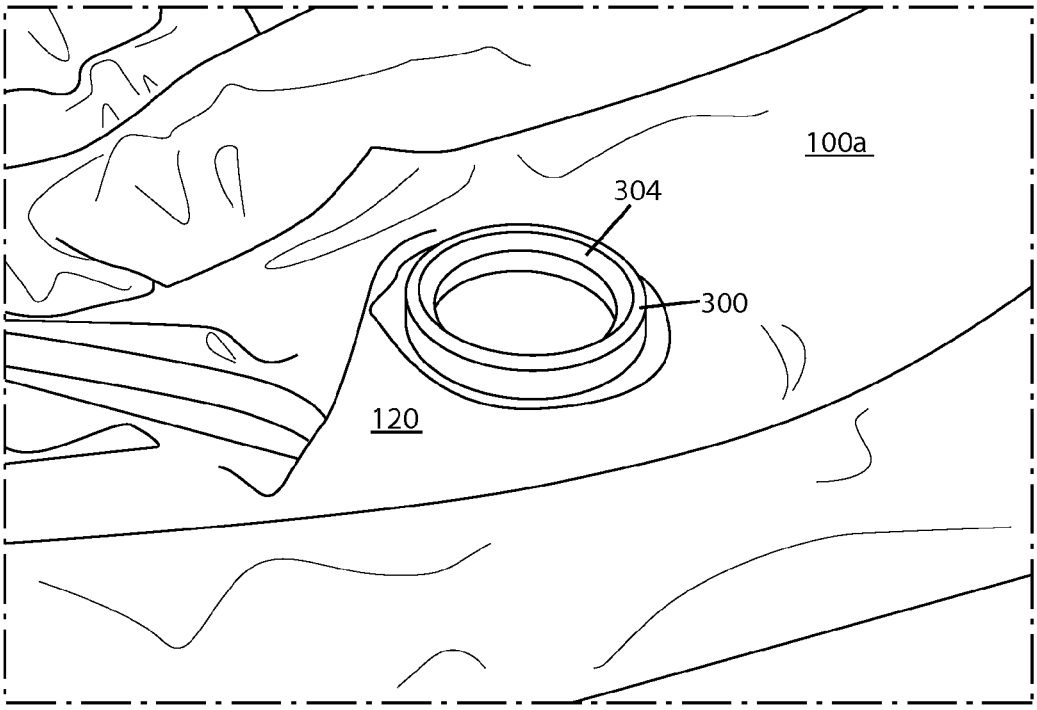
Figure 7C:
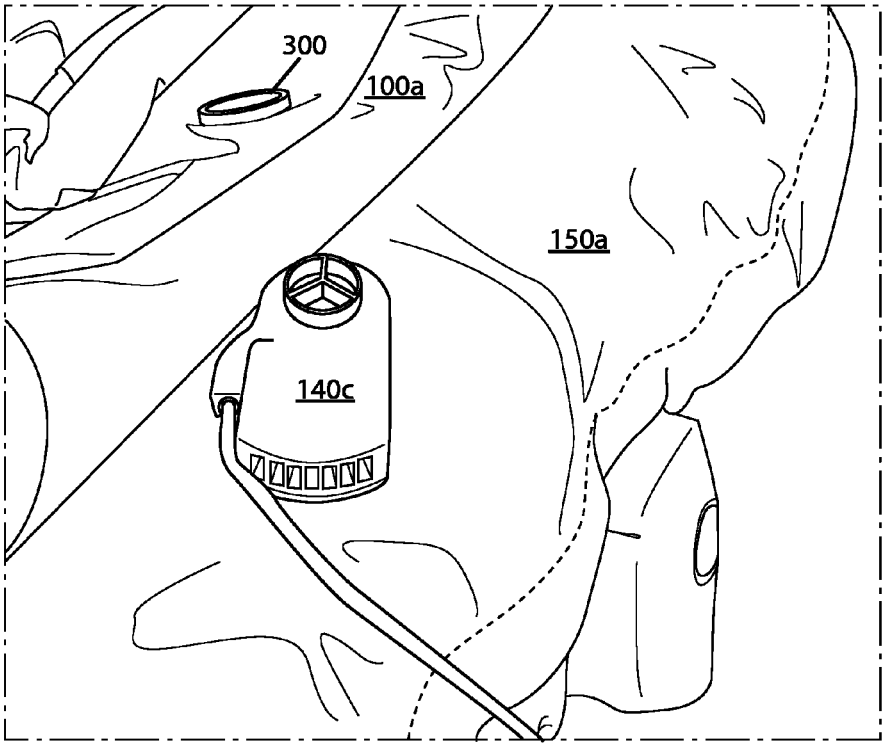
Figure 7D:
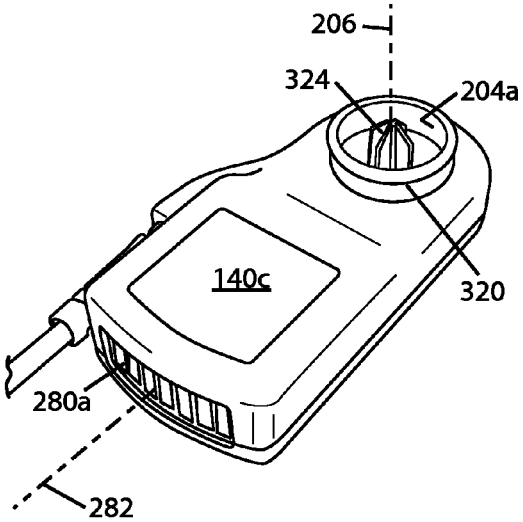
Figure 7E:
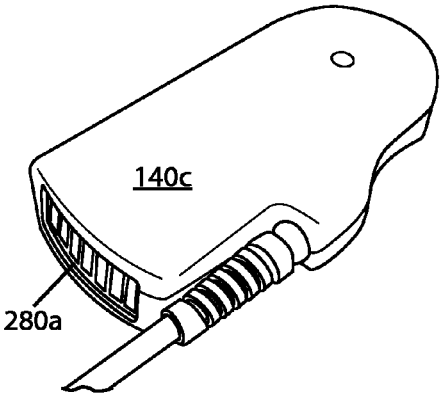
Figure 7F:
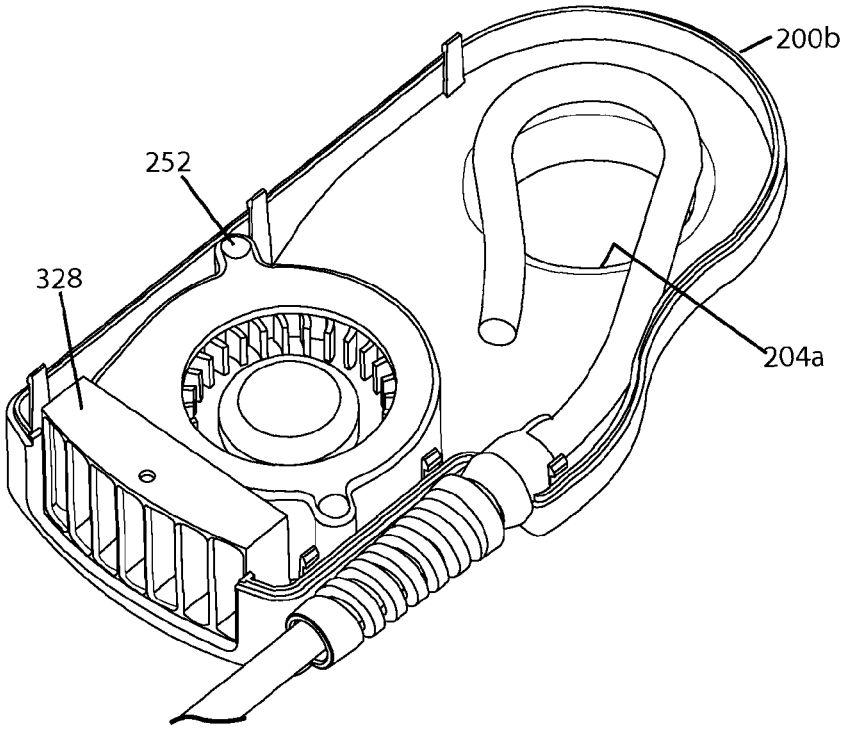
Figure 7G:
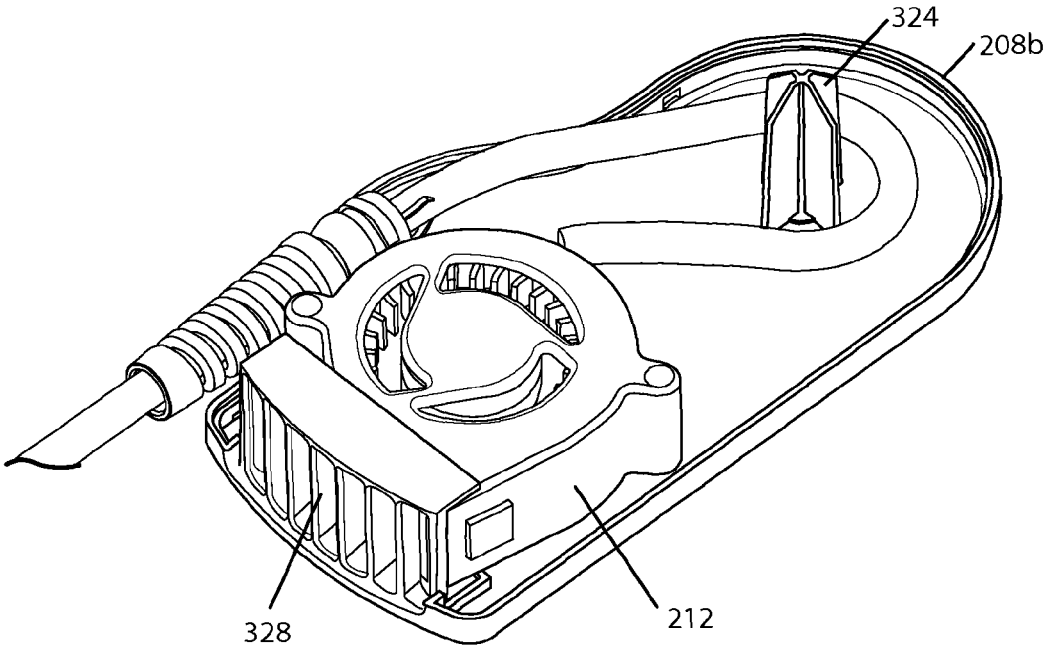
Figure 7H:
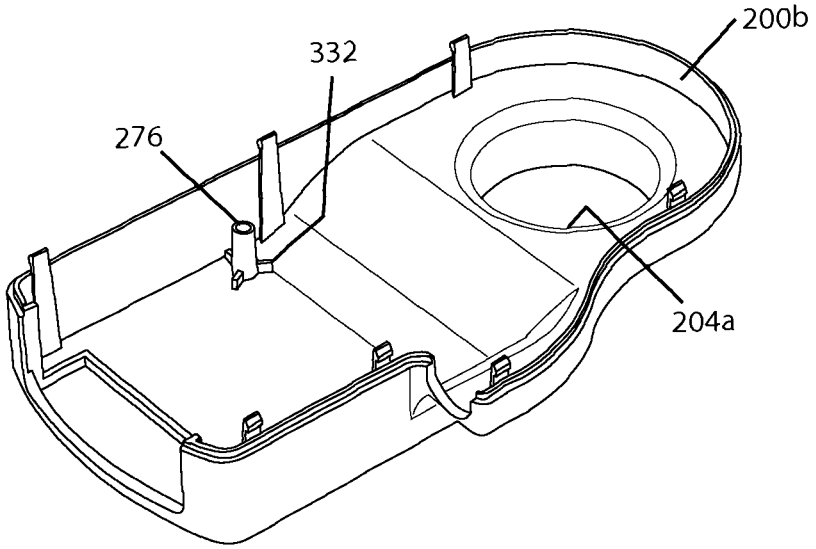
Figure 7I:
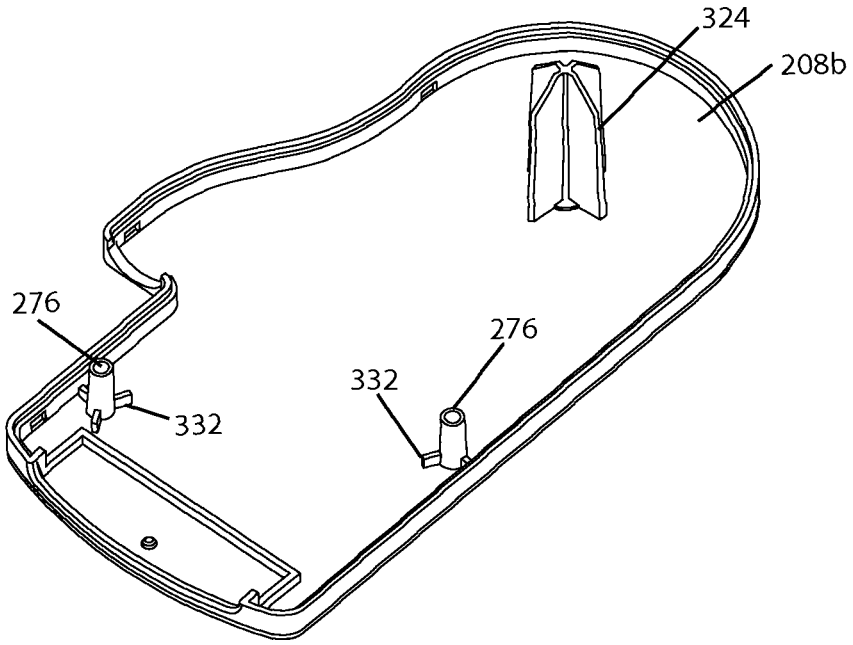

FIGS. 7A-7I depict various views of an embodiment of the present LAL patient supports, including a mattress 150*a*, an LAL coverlet 100*a*, and another embodiment 140*c* of the present airflow units. FIG. 7A depicts an edge (e.g., a foot end) of a mattress 150*a*. FIG. 7B depicts an internal side of a coverlet 100*a* (e.g., a portion of second layer 120 configured to be disposed adjacent the portion of mattress 150*a* depicted in FIG. 7A. FIG. 7C depicts another embodiment 140*c* of an airflow unit with mattress 150*a* (FIG. 7A) and coverlet 100*a* (FIG. 7B).

In the embodiment shown, coverlet 100*a* is substantially similar to coverlet 100. For example, coverlet 100*a* comprises a coverlet comprising: a first layer 110 (e.g., comprising a vapor-permeable and liquid-impermeable material), and a second layer 120 (e.g., comprising a vapor-permeable and liquid-impermeable material) coupled to first layer 110 such that a plurality of flow paths 130 are formed between first layer 110 and second layer 120, as described above. In the embodiment shown, coverlet 100*a* comprises a coupling member 300 in fluid communication with flow paths 130, such that airflow unit 140*c* can be coupled to coupling member 300 to enable fluid communication between airflow unit 140*c* and flow paths 130. Coupling member 300 can comprise a resilient material such as silicone, polyvinyl chloride (PVC), rubber, and/or latex. In the embodiment shown, coupling member is circular (e.g., has a ring shape), and includes a tapered internal edge 304 to facilitate coupling to airflow unit 140*c*.

In the embodiment shown, mattress 150*a* includes a compartment 308 configured to removably receive airflow unit 140*c*. For example, as shown, mattress 150*a* includes a sheet of material 312 forming a generally rectangular pocket with an open bottom. In the embodiment shown, mattress 150*a* also comprises a passage 316 (through material 312) configured to permit coupling member 300 (of coverlet 100*a*) to be coupled to airflow unit 140*c* if the airflow unit is disposed in compartment 308. Material 312 can comprise, for example, one or more of the same material(s) that form mattress 150*a*.

FIGS. 7D-7I depict various views of airflow unit 140*c* and components of airflow unit 140*c*. Airflow unit 140*c* is similar to airflow units 140, 140*a*, and 140*b*, and the differences are primarily described here. In the embodiment shown, airflow unit 140*c* comprises: a first housing member 200*b*; a second housing member 208*b* coupled to first housing member 200*b*; and an air mover 212 disposed between first and second housing members 200*b* and 208*b*. In the embodiment shown, first and second housing members 200*b* and 208*b* (e.g., one or both of the first and second housing members) define a first opening 204*a* having a first axis 206, and a second opening 280*a* having a second axis 282 that is not parallel (e.g., perpendicular, as shown) to first axis 206. In other embodiments, first axis 206 may be parallel to second axis 282. Airflow unit 140*c* (e.g., at least one of first and second housing members 200*b* and 208*b*) also comprises a flange 320 surrounding first opening 204*a*. Flange 320 is configured to be removably coupled to coupling member 300 of coverlet 100*b*. For example, in the embodiment shown, flange 320 is configured to fit into coupling member 320 (e.g., such that coupling member 300 stretches slightly to fit snugly around flange 320 to seal the interface therebetween) to permit or enable fluid communication between airflow unit 140*c* and flow paths or channels 130 of coverlet 100*b*. In other embodiments, flange 320 may be configured to fit around coupling member 300. In the embodiment shown, flange 320 is unitary with first housing member 200*b* and extends (e.g., outwardly) from first housing member 200*b* in a direction that is substantially parallel to first axis.

In the embodiment shown, airflow unit 140*c* also includes guide vanes 324 configured to align fluid flowing through first opening 204*a*. In the embodiment shown, guide vanes are unitary with second housing member 208*b* and are configured to extend from second housing member 208*b* such that when first and second housing members 200*b* and 208*b* are coupled together, at least part of guide vanes 324 extend through first opening 204*a*, and/or prevent or decrease the likelihood of fabric or other items entering first opening 204*a*. In other embodiments, guide vanes 324 may be omitted, and/or airflow unit 140*c* (e.g., first housing member 200*b*) may include a grating or the like over or dividing first opening 204*a* to align fluid flowing through first opening and/or reduce the likelihood of items entering first opening 204*a*. In the embodiment shown, airflow unit 140*c* also comprises grating member 328 that is disposed between second opening 280*a* and air mover 212 to reduce the likelihood of fingers or other objects extending into air mover 212 (e.g., during use). In other embodiments, grating member 328 may be unitary with first housing member 200*b* and/or second housing member 208*b*.

In the embodiment shown, airflow unit 140*c* is also different from airflow units 140*a* and 140*b* in that air mover 212 is laterally spaced from first opening 204*a*. As a result, first and second housing members 200*b* and 208*b* are configured to provide a space between air mover 212 and one or both of first and second housing members 200*b* and 208*b*, respectively. For example, in the embodiment shown, first and second housing members 200*b* and 208*b* include spacer members 332 at the base of pins 276. In this way, when pins 276 extend into holes 252 of air mover 212 to fix the position of air mover 212, spacer members 332 ensure that an air gap is maintained between air mover 212 and first and second housing members 200*b* and 208*b*, respectively. Other embodiments may provide for airflow between air mover 212 and first opening 200*b* in other ways. For example, first housing member 200*b* and/or second housing member 208*b* may be provided with enlarged flow paths (e.g., non-planar outer walls) between first opening 204*a* and air mover 212 to permit air to flow therebetween.

In the embodiment shown, coverlet 100*a*, mattress 150*a*, and airflow unit 140*c* are configured such that the open end (shown at bottom in FIG. 7A) of compartment 308 faces downward when the mattress is configured to support a patient. Airflow unit 140*c* can thus be inserted in an upward direction (with the end closes to first opening 204*a* facing upward) such that first opening 204*a* and flange 320 aligned with passage 316 (e.g., such that flange 320 (if long enough) can extend through passage 316. Additionally, coverlet 100*a* can be extended over mattress 150*a* such that second layer 120 is adjacent (and/or closer than first layer 110 to) mattress 150 and coupling member 300 can be aligned with passage 316 and coupling member 320. Coupling member 300 can then be pressed or otherwise disposed over and around flange 320 to permit fluid communication between airflow unit 140*c* (air mover 212) and flow paths or channels 130 of coverlet 100*a*. In the embodiment shown, airflow unit 140*c* is configured to "pull" air from channels or flow paths 130, through first opening 204*a*, into air mover 212, and out second opening 280*a*. In other embodiments, airflow unit 140*c* can be configured draw air through second opening 280*a*, into air mover 212, and to "push" the air into channels or flow paths 130 through first opening 200*b*.

Figure 8A:
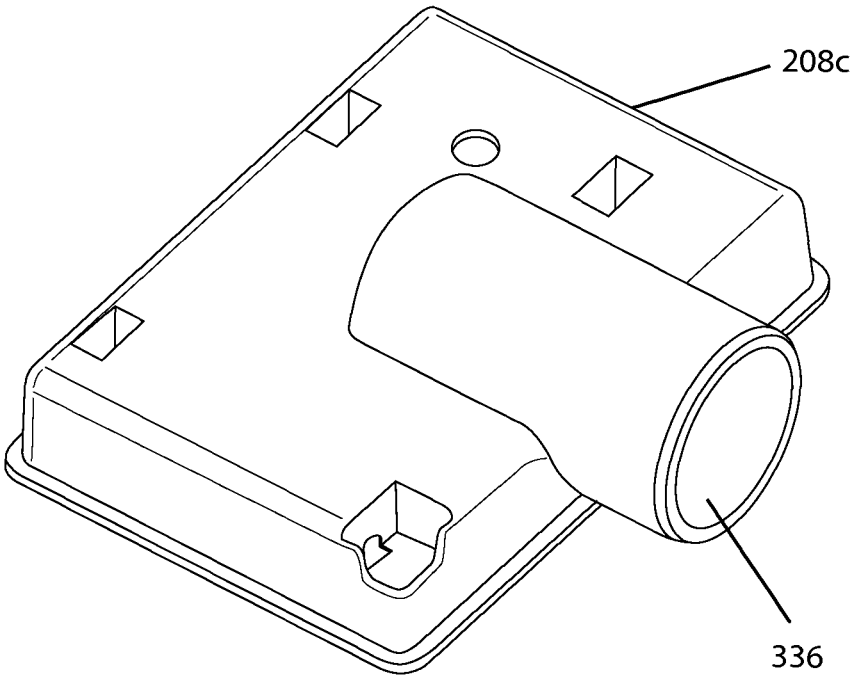
FIGS. 8A-8B depict various views of another one of the present airflow units for LAL patient supports such as the one depicted in FIGS. 1A-4.
Figure 8B:
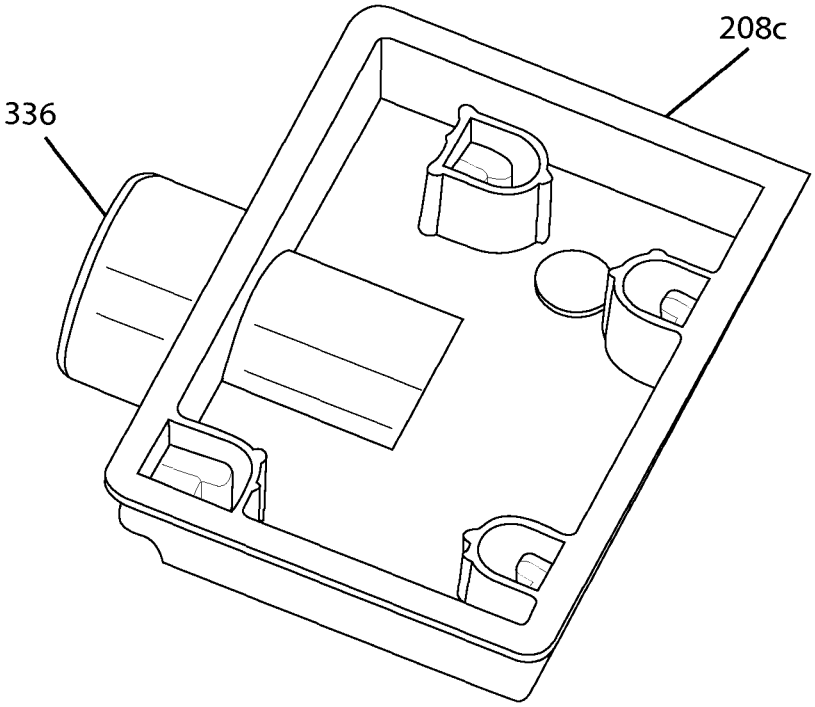

FIGS. 8A-8B depict various views of another embodiment of the present airflow units for LAL patient supports such as the one depicted in FIGS. 1A-4. More particularly, FIGS. 8A-8B depict an alternate embodiment of a second housing member 208*c* that is configured for use with first housing member 200*a* of FIGS. 6A-6D in the manner described above. In the embodiment shown, second housing member 208*c* differs from second housing member 200*a* in that it comprises a flange 336 configured to be coupled to a conduit (not shown) such that an air mover can be coupled to the conduit for fluid communication between the air mover and a coverlet (e.g., the plurality of flowpaths 130 of the coverlet). For example, in the embodiment shown, a conduit such as a tube or the like can be coupled to an air mover such as a blower that is remote from second housing member 208*c* (e.g., disposed in a footboard or external unit) to move air into or out of the coverlet. Because second housing member is not configured to house an air mover, pins 276 and openings 280 can be, and are shown, omitted.

Figure 9:
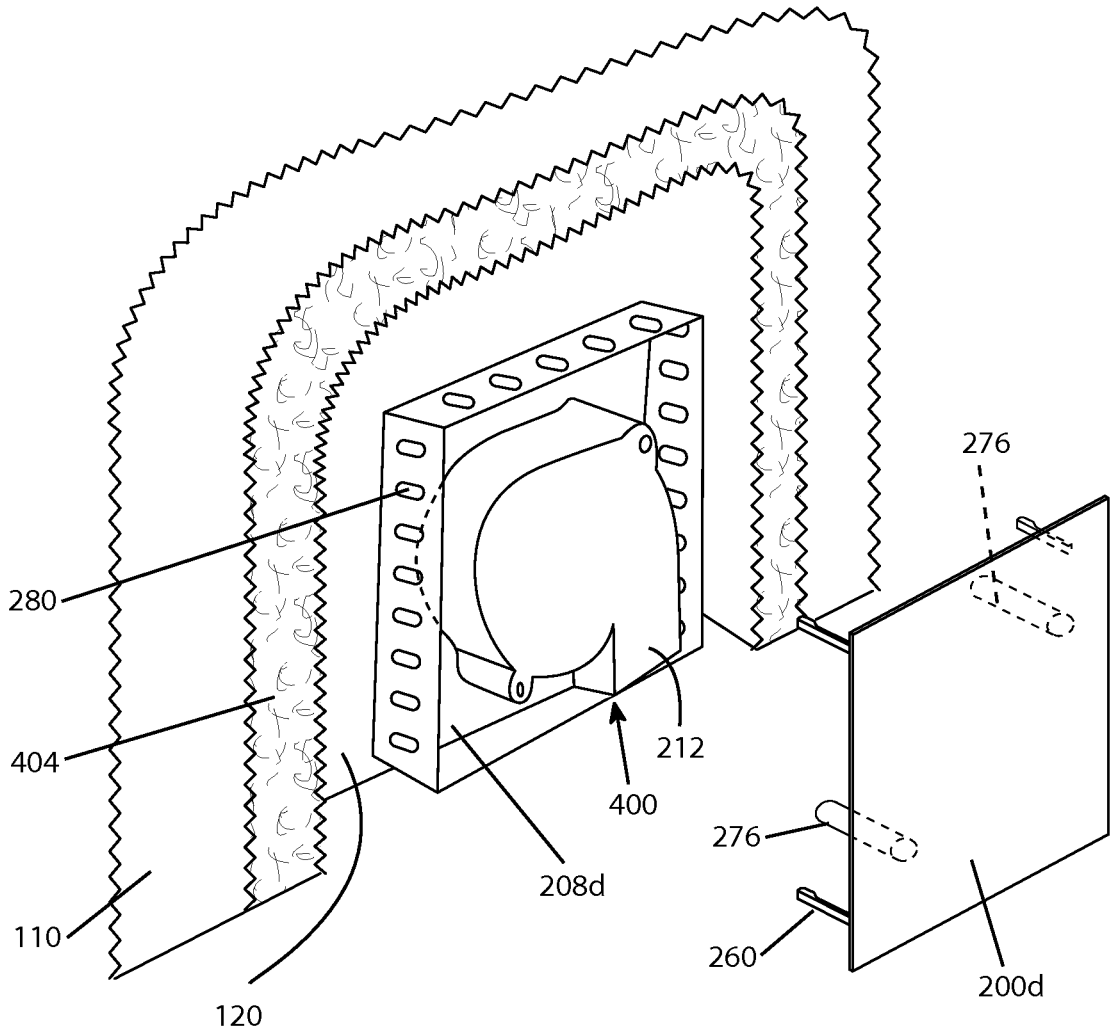
FIG. 9 depicts a partially cutaway perspective view of another one of the present airflow units for LAL patient supports such as the one depicted in FIGS. 1A-4.

FIG. 9 depicts a partially cutaway perspective view of another embodiment of the present airflow units for LAL patient supports such as the one depicted in FIGS. 1A-4. In the embodiment shown, first housing member 200*d* and second housing member 208*d* are configured to be coupled to the coverlet such that air mover 212 is disposed between first layer 110 and second layer 120. More particularly, in the embodiment shown, first housing member 200*d* does not include an opening and is configured to be coupled to the coverlet such that protrusions 260 extend through first layer 110 to couple to second housing member 208*d* (which is configured to be disposed between first layer 110 and second layer 120. Alternatively, first housing member 200*d* can be coupled (e.g., via adhesive, stitches, rivets, etc.) to an interior surface of first layer 110 such that both of first housing member 200*d* and second housing member 208*d* are disposed between first layer 110 and second layer 120.

In the embodiment shown, second housing member 208*d* includes openings 280 configured to permit fluid communication between air mover 212 and channels 130 such that air mover 212 can draw fluid through channels 130, through openings 280, into air mover 120, and out of the airflow unit (and coverlet) through an opening 400 (or draw fluid in through opening 400 and push it to channels 130). In the embodiment shown, the coverlet includes a spacer layer 404, which may be any suitable material, as discussed above, which permits or provides channels or flowpaths 130 between first layer 110 and second layer 120.

The various illustrative embodiments of the present devices and kits are not intended to be limited to the particular forms disclosed. Rather, they include all modifications and alternatives falling within the scope of the claims. For example, embodiments other than the one shown may include some or all of the features of the depicted embodiment.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A support system comprising:

a coverlet comprising:

a first layer comprising a vapor-permeable and liquid-impermeable material; and a second layer comprising a liquid-impermeable material, the second layer coupled to the first layer such that a plurality of flow paths are formed between the first layer and the second layer; and an airflow unit comprising:

a first housing member having at least one opening in fluid communication with the plurality of flow paths;

a second housing member coupled to the first housing member;

an air mover disposed between the first and second housing members; and a first gasket to seal the joint between the first and second housing members;

where the airflow unit is coupled to the coverlet with a second gasket to substantially seal the airflow unit to the coverlet such that the air mover can be activated to move air through the plurality of flow paths; and wherein first and second gaskets have complementary shapes.

2. The system of claim 1, where the second layer comprises a vapor-permeable material.

3. The system of claim 1, where the support system is configured to be disposed of after a single use.

4. The system of claim 1, where the first housing member is coupled to the second layer.

5. The system of claim 4, where the second layer has an inner side facing toward the first layer, and an outer side facing away from the first layer, and where the second housing member is disposed on the outer side of the second layer.

6. The system of claim 4, where the first housing member is disposed between the first layer and the second layer.

7. The system of claim 6, where the air mover is disposed between the second layer and the second housing member.

8. The system of claim 6, where the first housing member includes two or more protrusions extending through the second layer, and the second housing member is coupled to the two or more protrusions.

9. The system of claim 8, where the two or more protrusions each includes a barb, and the second housing member includes two or more tabs coupled to the barbs.

10. The system of claim 1, where the second layer comprises a plurality of protrusions.

11. The system of claim 1, where the coverlet is configured to be coupled to a support member.

12. The system of claim 11, where the coverlet further comprises a coupling member configured to couple the support system to a support member.

13. The system of claim 1, where the support system is configured such that if the air mover is activated while a patient is disposed on the coverlet:

moisture vapor will transfer through the first layer into the plurality of flow paths; and the air mover will transfer the moisture vapor from the plurality of flow paths, through the inlet housing of the first housing member, and to an exterior of the coverlet.

14. An airflow unit for use with a low-air-loss coverlet comprising a first layer and a second layer coupled to the first layer such that a plurality of flow paths are formed between the first layer and the second layer, the airflow unit comprising:

a first housing member having two or more protrusions, the first housing member configured to be disposed between first and second layers of a coverlet such that the two or more protrusions extend through the second layer;

a second housing member configured to be coupled to the two or more protrusions on an opposite side of the second layer from the first housing member; and an air mover configured to be disposed between the first and second housing members such that if the airflow unit is coupled to a coverlet, the air mover can be activated to move air in the plurality of flow paths.

15. The airflow unit of claim 14, where at least one of the first and second housing members comprises one or more pins, and the air mover comprises one or more holes corresponding to the one or more pins, such that if the one or more of pins extend into the one or more corresponding openings, and the second housing member is coupled to the first housing member, the air mover is substantially fixed relative to the one of the first and second housing members.

16. An airflow unit for use with a low-air-loss (LAL) coverlet, the airflow unit comprising:

a first housing member;

a second housing member coupled to the first housing member;

an air mover disposed between the first and second housing members;

where the first and second housing members define a first opening and a second opening; and where at least one of the first and second housing members includes a flange surrounding the first opening, the flange configured to be removably coupled to a coupling member of a coverlet such that the airflow unit is in fluid communication with the air mover.

17. The airflow unit of claim 16, where the airflow unit comprises guide vanes configured to align fluid flowing through the first opening.

18. The airflow unit of claim 16, where the flange extends from the at least one of the first and second housing members in a direction that is substantially parallel to the first axis of the first opening.

19. The airflow unit of claim 18, where the first axis of the first opening is substantially perpendicular to the second axis of the second opening.

20. The airflow unit of claim 16, where the first opening has a first axis, and the second opening has a second axis that is not parallel to the first axis.

21. A support system comprising:

an airflow unit comprising:

a first housing member;

a second housing member coupled to the first housing member;

an air mover disposed between the first and second housing members;

where the first and second housing members define a first opening and a second opening; and where at least one of the first and second housing members includes a flange surrounding the first opening, the flange configured to be removably coupled to a coupling member of a coverlet such that the airflow unit is in fluid communication with the air mover; and a coverlet comprising:

a first layer comprising a vapor-permeable and liquid-impermeable material;

a second layer comprising a liquid-impermeable material, the second layer coupled to the first layer such that a plurality of flow paths are formed between the first layer and the second layer; and a coupling member in fluid communication with the plurality of flow paths;

where the coupling member is coupled to the flange of the airflow unit such that the air mover is in fluid communication with the plurality of flow paths.

22. The support system of claim 21, further comprising:

a mattress comprising a compartment configured to removably receive the airflow unit of claim 17, the mattress comprising a passage configured to permit the coupling member of the coverlet to be coupled to the flange of the airflow unit if the airflow unit is received in the compartment.

23. The support system of claim 21, where the second layer comprises a vapor-permeable material.

24. The support system of claim 22, where the coverlet is configured to be coupled to the mattress such that the coupling member of the coverlet can be coupled to the flange of the airflow unit if the airflow unit is received in the compartment of the mattress.

* * * * *